US007600345B2

(12) United States Patent
Slopack

(10) Patent No.: US 7,600,345 B2
(45) Date of Patent: Oct. 13, 2009

(54) SWING DOOR OPERATING SYSTEM

(76) Inventor: Marlene Rene Slopack, 60 Kings College Road, Thornhill, On. (CA) L3T 5J8

( * ) Notice: Subject to any disclaimer, the term of this patent is extended or adjusted under 35 U.S.C. 154(b) by 255 days.

(21) Appl. No.: 11/439,978

(22) Filed: May 25, 2006

(65) Prior Publication Data

US 2007/0271851 A1 Nov. 29, 2007

(51) Int. Cl.
*E05F 15/12* (2006.01)

(52) U.S. Cl. ..... 49/358; 49/25

(58) Field of Classification Search ..... 49/324, 49/325, 331, 332, 342, 347, 358, 199
See application file for complete search history.

(56) References Cited

U.S. PATENT DOCUMENTS 1,326,286 A * 12/1919 Perkins ..... 74/89.22
3,012,520 A * 12/1961 Curtis ..... 104/235
3,785,089 A * 1/1974 Smith ..... 49/139
4,167,833 A * 9/1979 Farina et al. ..... 49/199
4,348,835 A * 9/1982 Jones et al. ..... 49/139
4,924,626 A * 5/1990 Ts'ao ..... 49/347
5,046,283 A * 9/1991 Compeau et al. ..... 49/138
5,076,016 A * 12/1991 Adams et al. ..... 49/360
6,061,964 A * 5/2000 Arnell et al. ..... 49/359
6,751,909 B2 * 6/2004 Ranaudo ..... 49/506

* cited by examiner

*Primary Examiner*—Katherine W Mitchell
*Assistant Examiner*—Michael J Keller
(74) *Attorney, Agent, or Firm*—D. W. Eggins; Douglas Eggins

(57) ABSTRACT

A door actuating system has a fractional horsepower motor mounted on the door adjacent its free edge, driving a clutch connected to a duplex capstan pulley that is wrapped by two tensioned flexible static lines, for opening/closing movement 'along the line'. The motor also drives a gear that engages a rack projecting from the door frame, to displace the door relative to its frame. Rotation of the gear is read by a rotary encoder, which feeds a microprocessor, to continuously monitor the location, speed and direction of motion of the door, for both the 'on' and the 'off' condition of the electric motor. A latching clip over-rides action of the original door latch.

16 Claims, 5 Drawing Sheets

SWING DOOR OPERATING SYSTEM

CROSS-REFERENCE TO RELATED APPLICATIONS

Not Applicable (N/A)

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING

N/A

COMPACT DISC APPENDIX

N/A

BACKGROUND OF THE INVENTION

1. The present invention is directed to a hands-free system for opening and closing hinged domestic doors, such as bathroom or other household doors, and is characterized by its safety and simplicity, and the low cost which makes it more available to the general public.

2. Previously existing door opening systems are characterized by their complexity and high cost, which disqualifies them from widespread use by average householders. All known door openers/closer systems use a single anchor point and a single door attachment point, so that the door is subject to being pushed in one direction, and to being pulled for movement in the opposite direction.

BRIEF SUMMARY OF THE INVENTION

The present invention provides a simple, low-cost, reliable system for the opening and closing of standard, hinged domestic doors. The system is primarily actuated by a door-mounted, motor-driven pair of capstan pulleys that transfer themselves by reeling in a tensioned flexible static line in a door-opening or door-closing action.

The paired capstan pulleys, each with its respective tensioned flexible line are used for purposes of reliability and simplified operation.

The system also includes a secondary door displacement mechanism, for displacing and re-housing the door, relative to the door frame, so as to displace the door from its closed position within the door frame, upon initiating opening, and to return the door to its fully closed position within the door frame, for complete closure.

The system also includes a door position-monitoring subsystem that uses a toothed wheel coupled to the motor-driven pulleys, and a rotational encoder comprising an optical or magnetic sensor or a mechanical counter that simply counts the gear teeth in a positive or negative (opening or closing) sense as they pass, on rotation of the pulleys. The rotational encoder is connected to a microprocessor, the encoder being responsive to displacement of the door 'along' the static lines, and acting independently of whether or not the door is motor driven or positioned by an external agency, such as being moved manually by an individual.

The system is powered by a small, electric motor that is mounted high up on the door, adjacent its free edge, having a duplex pulley that engages a pair of anchored, tensioned transfer lines, to draw the door along the lines towards a line-anchoring position on an adjacent wall, in an opening sense, or towards a line-anchoring position located above the door jamb, when operating in a closing sense. Thus, in both 'opening' and 'closing' phases of its operation, the system works with its two transfer lines in a tensioned condition.

The motor also drives the secondary door displacement means, comprising a toothed gear, driven by the motor, that engages a rack mounted upon and projecting inwardly from the door frame. Its operation serves to displace the door outwardly from its frame, on its initial, opening disengagement from the door frame; and to return the door inwardly, into the frame, to engage the door jamb, in order to complete its closure.

The system is controlled by a microprocessor, and is fail-safe. Disconnection of the motor from its power source, by the microprocessor or as a result of external power loss leaves the door free and unrestricted, for manual opening and closing.

The present invention provides an automatic door actuating system for actuating a door in opening and closing displacement, the system having a reversible electric motor mounted adjacent the free edge of the door, the motor being in driving relation with pulley means, the pulley means engaging tensioned flexible line means, the line means extending substantially horizontally between a first attachment point on a lintel portion of the door frame and a second attachment point located adjacent the door free edge when the door is in a fully open position; and means to energize the motor in a selected mode of opening and closing rotation, whereby, upon energization of the motor the pulley means engages the line means to draw the door in a respective opening/closing displacement This door actuating system, includes clutch means interposed between the motor and the pulley means, to disconnectably connect the motor with the pulley means.

The door actuating system includes gear wheel means secured to the pulley, for rotation therewith, and rack means projecting from the door lintel to engage the gear wheel means when the door is in a substantially closed position, whereby the motor can displace the door relative to the frame, independently of the flexible line.

The door actuating system includes encoder means positioned in motion reading relation with the gear means, to provide signal outputs related to door displacement.

The door actuating system includes reduction gear means connecting the motor with the clutch means, where the clutch means is electrically actuated to selectively engage the electric motor with the pulley only upon energization of the clutch.

The system includes microprocessor means connected in signal-receiving relation with the encoder means, the microprocessor being connected in energizing relation with the electric motor.

The present invention provides an automatic door actuating system for actuating a hinged door wherein the tensioning of the lines is achieved by a tensioning spring located at a second attachment point positioned adjacent the door free edge when open.

The subject door actuating system has enclosure means extending beneath the electric motor in access limiting relation therewith.

The system also includes resilient latch clip means mounted in displacing relation with a latch portion of the door, in use to over-ride the operation of the door latch portion upon displacement of the door by the application of force against it.

The microprocessor circuitry includes a back-up battery; jack means for connection to a household electrical supply, to energise the microprocessor; a plurality of output relays respectively connected with the motor and the clutch; an infra-red signal receiver; variable potentiometer means for selectively controlling a selected time-function of the microprocessor; infra-red tuning means for selecting a predetermined I/R code to signal the microprocessor, a plurality of function-modifying dip switches, to enable the programming of the microprocessor; and at least one on/off control switch to de-energise the motor.

The opening and closing forces generated by the system are sufficiently low to permit manual over-ride by the application of moderate force. Also, the system detects any external interference in the condition of the door, such as contact being made against the outside of the door when in an 'at-rest' condition, sufficient to register door movement with the rotational encoder, which signals the microprocessor, resulting in the energizing of the electric motor in a door-opening sense, and, in the case of contacts being made against the moving door when being driven, so as to change the rate of movement sensed by the encoder, this changed rate is transmitted to the microprocessor, which then terminates energization of the motor, and disconnects the clutch. This leaves the door free for movement by hand, during which the encoder maintains its 'registry', so that the microprocessor is notified of changes in the position of the door.

In the preferred embodiment, a door-mounted fractional horsepower electric motor drives a high ratio reduction gear, the output shaft of which connects through a magnetic clutch to a coaxial gear wheel/twin pulley. The capstan-style twin pulleys engage the aforesaid stationary, tensioned twin-lines, and with the door closed the gear wheel engages the door-frame rack. The encoder monitors rotational changes of the gear wheel, either mechanically or optically.

The position encoder means connecting with the pulley/toothed gear, consisting of an rotational encoder, monitors the rotational displacement of the gear, corresponding to the displaced location of the door, at all times. The encoder is coupled to a microprocessor which 'reads' the door's condition, in terms of displacement, and hence its instant location; also, the rate of gearwheel rotation is read, and hence the displacement speed of the door, both when being driven by the system, or when manually controlled.

The microprocessor is directly connected (i.e. through built-in relays) in controlling relation with the electric motor and also with the magnetic clutch.

The encoder/microprocessor also senses changes in door speed that may result from contact being made against the door, and is programmed to then de-energise the motor, and disengage the magnetic clutch, to terminate the drive. In this condition, the door is then free to be manually repositioned. Meanwhile, the encoder remains active, and transmits to the microprocessor all changes occurring in the pulley-driven gear, and hence ensures continuous determination of the instant location of the door.

The system electrical supply preferably consists of a transformer/converter connected to normal household supply to drive a low-voltage, direct current motor, and to energise the system control means. In the event that a 115V or 230V AC motor is used, the electrical supply is connected to conforming outlets, and the control means is adapted accordingly.

In operation, to activate the system from the "swing-away" or 'outer' side of the door, a slight opening push against the door produces interaction between the rack and pinion, with consequent rotational displacement of the pinion that is sensed by the encoder, which signals the microprocessor, which then energises the system in a door-opening mode.

The operation of the usual door latch mechanism is superseded by a latching clip which is secured to the door and overlies and restrains the spring latch from engagement with the latch plate.

The spring-steel latch clip has a pair of curved deformable cam-like surfaces which engage the original latch plate when the door is closed, and a miniscule latching surface located between the two curved cam surfaces, which engages the latch plate to hold the door closed, but which requires minimal force being applied against the door outer face to override the latch clip, and permit the door to open.

When the system is actuated and the door approaches its fully open position, the microprocessor is programmed to decelerate and stop the motor at a predetermined open position, as determined from the encoder input to the microprocessor The user, having proceeded past the opened door, then activates a wall-mounted TV-style broad beam IR transmitter, which signals the microprocessor, which is programmed to then energise the motor in a door-closing sense. The location of this IR control is not critical, due to its broad beam.

To exit the door, on approaching the closed door from within the room, the user activates the wall-mounted IR transmitter, which signals the microprocessor to energise the motor in a door-opening sense.

With the door having achieved the desired 'open' condition, the microprocessor may be programmed to 'pause', holding the door in its open condition for a predetermined delay period to give the user a sufficient time to pass through the doorway.

After the 'pause' the system is then energized by the microprocessor into its closing mode.

A contemplated alternative system control arrangement may incorporate a second I/R transmitter located on the outside of the door. Having exited through the door, the user activates the second IR transmitter which signals a receiver mounted on the door outer face and connected through the door to the microprocessor, to energise the motor in a door-closing mode.

The preferred embodiment uses two pulleys, with one pulley winding-on its flexible, tensioned line, while the other pulley correspondingly unwinds its respective flexible tensioned line. However, the use of a single tensioned line, wrapped capstan-style about a single pulley, is contemplated.

While the present disclosure is directed to a hinged door, it will be evident that the principles of the present invention may be readily applied to a sliding door.

BRIEF DESCRIPTION OF THE SEVERAL VIEWS OF THE DRAWING

Certain embodiments of the present invention are described by way of illustration, without limitation thereto other than as set forth in the claims hereof, it being evident that a person skilled in the art may readily evolve alternative embodiments, in light of the present disclosure and the accompanying drawings, wherein:

DETAILED DESCRIPTION OF THE INVENTION

Figure 1:
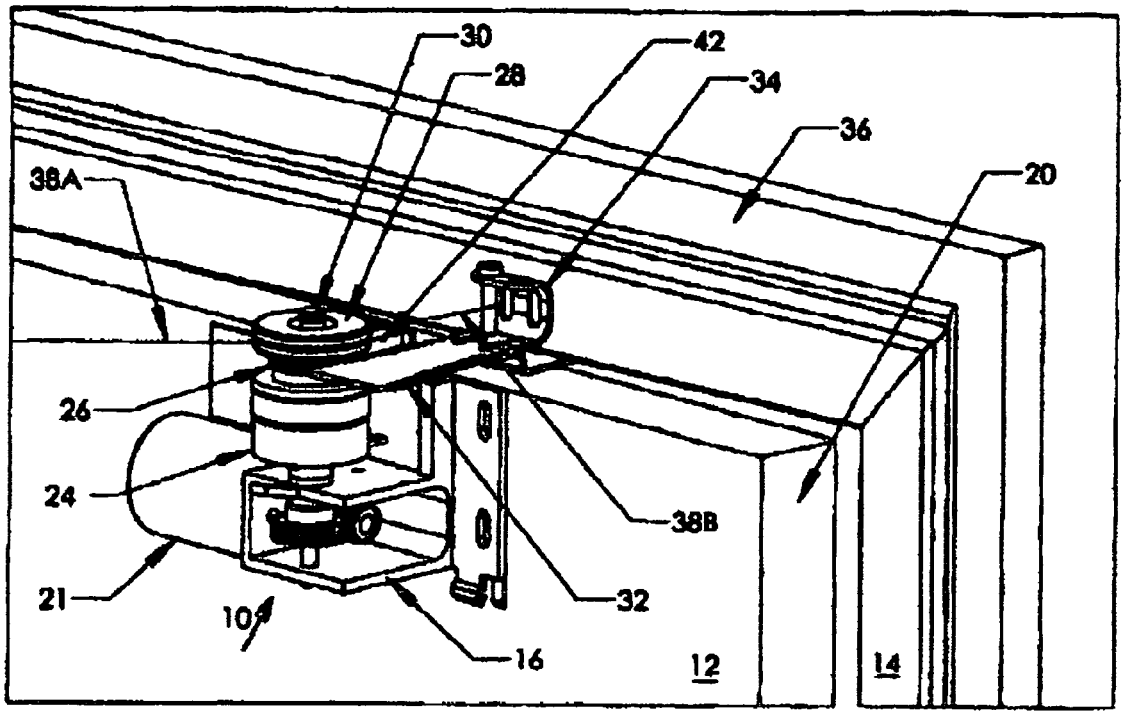
FIG. 1 is a perspective view from above of a portion of a partly opened door having installed thereon the primary mechanical elements of the present invention.
Figure 3:
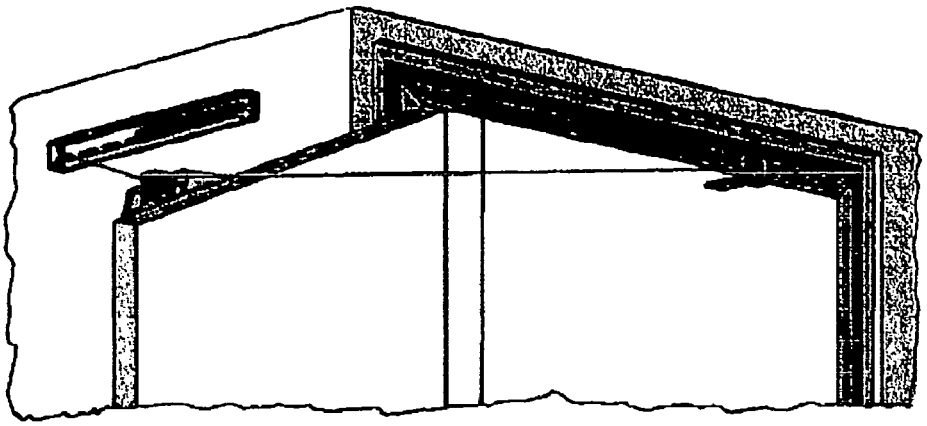
FIG. 3 is a view similar to FIG. 1, showing the door in a fully open position.

Referring to FIGS. 1 and 3, the system's actuating mechanical elements 10 are mounted in association with a hinged door 12 and its frame 14.

A bracket 16 secured to the top of a door 12 adjacent the door outer edge 20 carries the system mechanical elements 10. These comprise a fractional horsepower electric motor 21 having a reduction gear 22, connected by way of a magnetic clutch 24 to a pinion gear 26 attached to a pair of coupled, coaxial capstan-style pulleys 28, mounted upon the output shaft 30 of clutch 24.

The reduction gear 22 is a worm reduction gear. The alternative use of a wheel and pinion type reduction gear, with appropriate changes to the bracket 16 is contemplated. The gear reduction ratio is sufficiently high as to substantially preclude overhauling of the gear by the application of an opposing force acting upon the door.

With the closing door 12 approaching its frame 14, the pinion gear 26 engages with geared rack 32. Rotation of pinion gear 26 by the motor 21 in a door-closing or door opening mode serves to positively engage or to positively disengage the door 12 with its frame 14.

In FIG. 1 a pair of flexible lines 38A, 38B (such as nylon or stranded wire) each has one end secured to its respective pulley 28. The outer ends of lines 38B and 38A are respectively connected at the door lintel and at the wall towards which the door opens. The lines 38A, 38B are oppositely wound, such that rotation of the pulleys 28 in a first direction results in the winding onto its pulley 28 of line 38A and the substantially corresponding unwinding of line 38B from its pulley 28. Reversal of rotation of the pulleys 28 results in-the winding-on of line 38B and the corresponding unwinding of line 38A.

The lines 38A and 38B are maintained in a constantly tensioned state by way of tensioning device 35 (see FIG. 4), to which the outer end of line 38A is connected. This tensioning device 35 tensions line 38A, which serves to tension line 38B and compensates for any minor differences in the respective winding/unwinding rates of lines 38A/38B.

Figure 2:
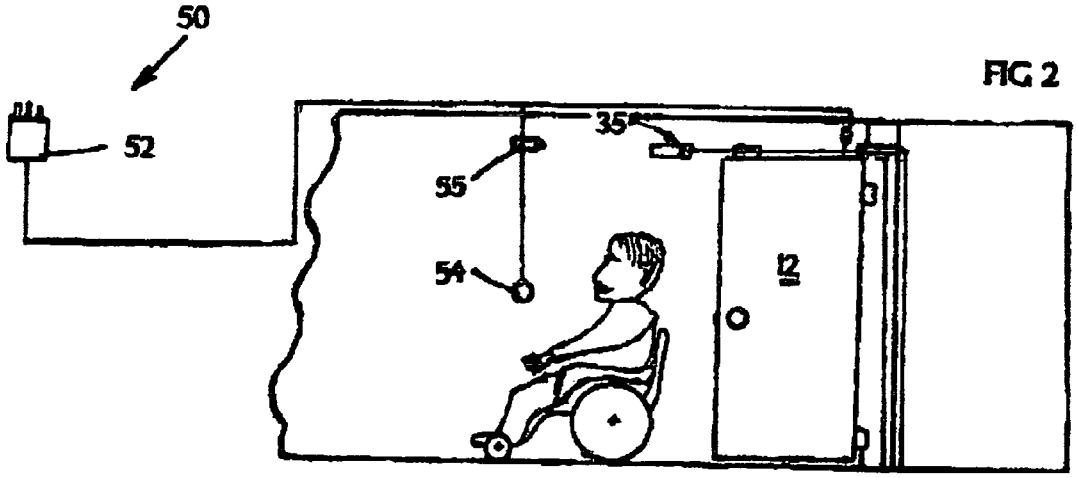
FIG. 2 is a side elevation showing the system in relation to a user;.

The complementary lines 38A/38B extend diagonally above head height, with the outer end of line 38A attached at 35 by way of a compensating spring 37 (see FIG. 4) to the wall that adjoins the door frame hinge side(see FIGS. 2 & 3).

The pinion gear 26, in addition to engaging the rack 32 is also utilized by an optical, magnetic or mechanical encoder 42, which continuously tracks the to and fro movement of the teeth of the gear 26. The output of encoder 42 is connected directly to a microprocessor 44, which converts the encoder signals to displacement and displacement rate values, thereby enabling the microprocessor to determine the location and rate of displacement of the door.

As the encoder is active for both manual or electrically driven displacement of the door, the microprocessor is continuously updated as to the condition of the door for both the driven and the manually displaced condition.

It will be understood that the term "manually displaced" is intended to cover all conditions of door displacement other than motor driven.

The microprocessor 44 is mounted upon and connected in direct controlling relation with the motor 21.

Referring to FIG. 2, the power source 50 for motor 21 includes a transformer/rectifier 52 that plugs into a normal household electrical outlet, to provide 12-volts DC.

Figure 4:
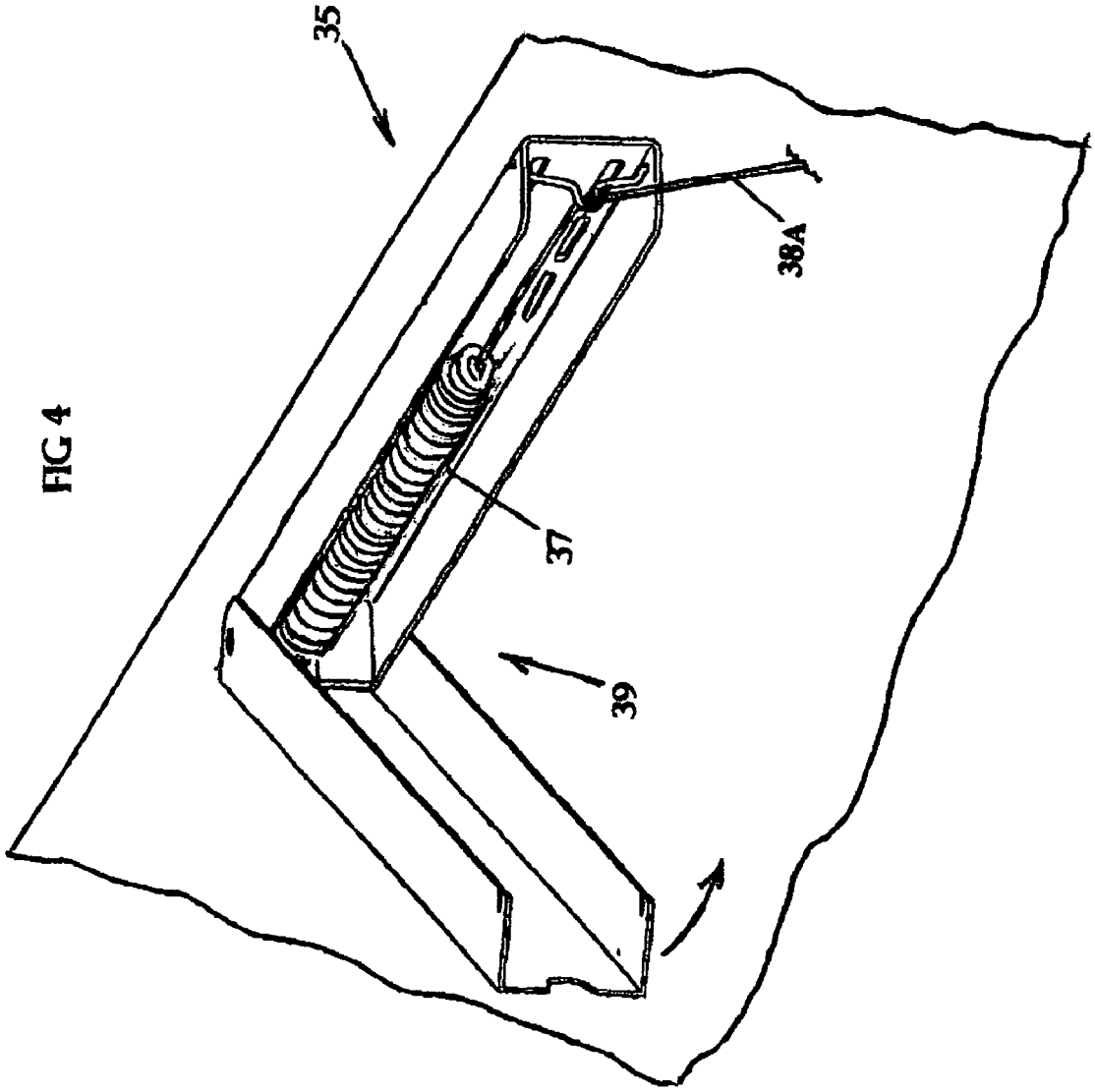
FIG. 4 is a perspective view of a wall-mounted line tensioning spring and housing.

Turning to FIG. 4, the wall attachment 35 of line 38A includes a hinged housing 39 within which a coiled compensating spring 37 is anchored. The housing 39 is secured high up, close to the ceiling, on the wall from which the door is effectively hinged, (see also FIG. 8) such that the lines 38A and 38B extend substantially horizontally, in a continuously tensioned condition.

Figure 5:
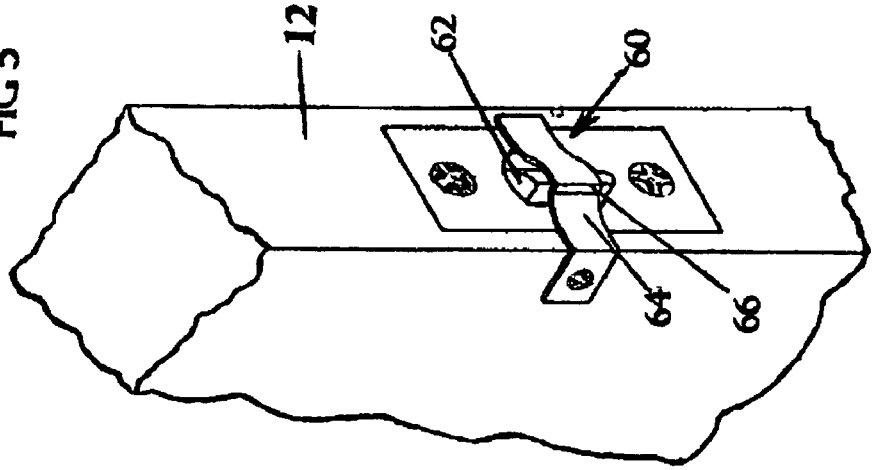
FIG. 5 is a perspective frontal view of a latching clip secured over the latch of a door.

Referring to FIG. 5, the door 12 has a latching clip 60 which overlies the original spring latch 62. The clip 60 has a radiused latching surface 64, with a minimal planar latching face 66, enabling the clip 60 and latch 62 to be overcome and depressed out of engagement with the door latchplate (not shown) by the application of a slight push against the door, or by the door-opening force provided by the action of the pinion gear, acting on the rack 32, which can then continue to move the door outwardly of its frame.

Figure 6:
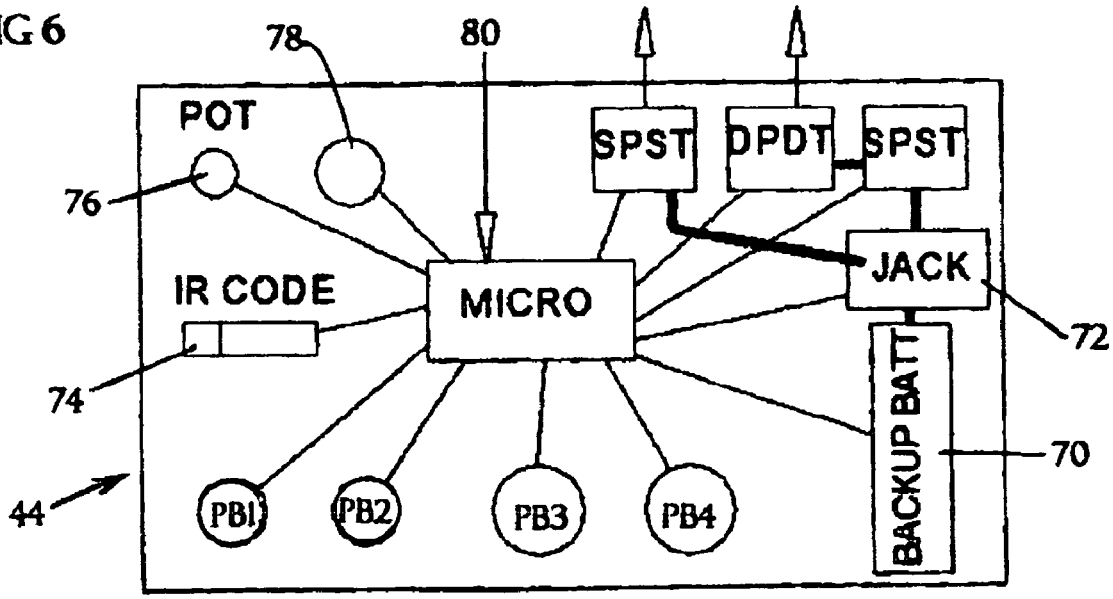
FIG. 6 is a circuit diagram of the system control circuitry.

Referring to FIG. 6, the controls and circuit connections for microprocessor 44 include a back-up battery 70, a jack connection 72 to the power source 52, an I/R code differentiating receiver 74, a potentiometer control 76 [for setting the door-now-opened pause time between 2 to 45 seconds], an infrared (I/R) actuated regulator 78, a single-pole single-throw (SPST) relay connected to the clutch 24, input line 80 from the encoder 42, a double-pole, double-throw (DPDT) relay connected to the motor 21, and a single-pole, single-throw (SPST') relay that controls power to the DPDT relay and a series of four push-button controls PB1, PB2, PB3 and PB4, connected to the microprocessor 44, respectively controlling: PB1—On/Standby; PB2 Auto/ Manual control; PB3-door Close-mode setting; PB4—door Open mode-setting.

The encoder 42 has an output line 43 connected as input to the microprocessor 44.

The microprocessor 44 has outputs 45, 47 connected respectively to the clutch 24 through the SPST clutch relay and to the motor 21 through the SPST motor relay.

The switching of the DPDT relay serves to reverse the voltage applied to the motor, but does not cut the power, which is the role of the SPST motor relay.

In use, upon a user approaching the door from the outside and applying gentle pressure against the closed door, the slight displacement of the door activates the encoder 42, by interaction of the gear 26 with the rack 32. The encoder 42 signals the microprocessor 44. The microprocessor 44 is programmed to act upon this minute-displacement signal, switching on the motor 21 in the opening mode, and energizing the clutch 24. The door-opening action is initially provided by the pinion gear 26 displacing itself along geared rack 32, to positively disengage the door 12 from its frame 14.

When the gear 26 vacates the rack 32, the opening of the door 12 is maintained by the pulley 28 drawing itself along the line 38A. This action is monitored by the encoder 42, which signals rotation of gear 26 to the microprocessor 44, which converts the input to functions of door position and speed of displacement. As the door 12 approaches a predetermined 'open' position, the microprocessor can stop the motor 21, with the clutch 24 still energized, thereby bringing the door to a halt.

It is also contemplated that the microprocessor may even reverse the motor 21, for a faster stopping of the door 12.

An I/R transmitter 55 (see FIG. 2) can be located in controlling relation with the microprocessor 44, which is preferably mounted on the casing of motor 21. The I/R transmitter 55, while illustrated as being mounted above head height, can readily function from other positions, by virtue of its broad I/R beam.

Figure 7:
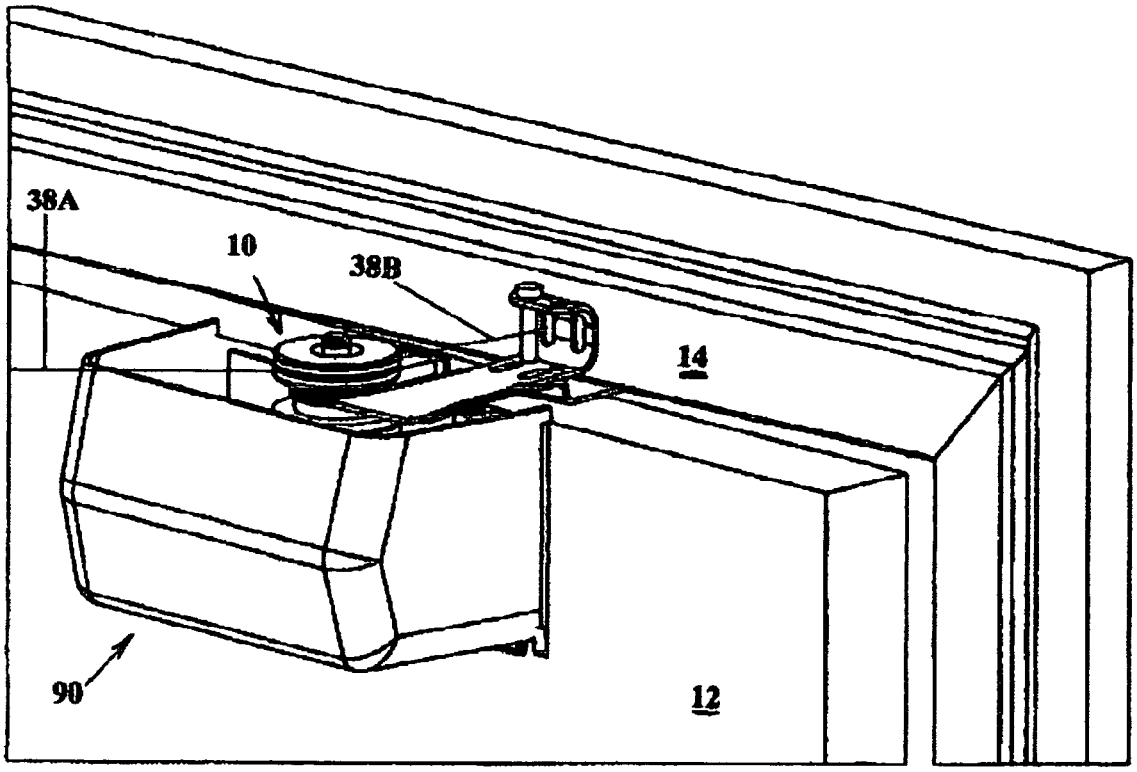
FIG. 7 is a perspective view similar to FIG. 1, with a protective cover installed; and, FIG. 8 is a fuller perspective view of FIG. 3.

Referring to FIG. 7, the system's actuating mechanical elements 10 are shown mounted in association with a hinged door 12 and its frame 14, being described in detail above, with reference to FIG. 1. The line 38B and a portion of its mutually complementary line 38A are shown. A protective housing 90 encloses the lower portion of the elements 10, with the lines 38A and 38B positioned above the housing 90

Figure 8:
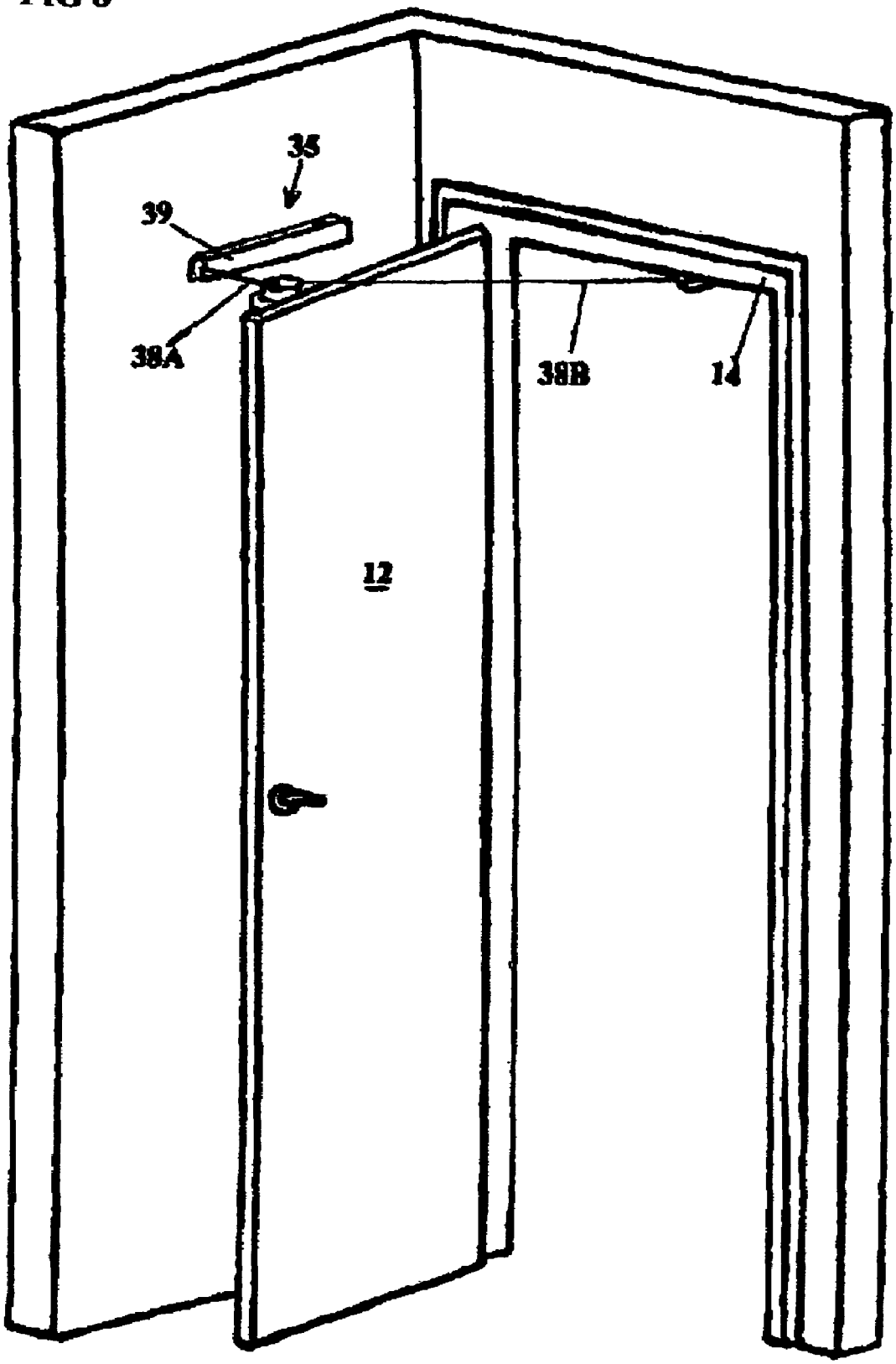

FIG. 8 better illustrates the relative locations of the door 12, in its fully open position, with the location of the line 38B extending across the top of the door 12, to its anchor point on the lintel 14, and the line 38A having its outer end attached to the coiled compensating spring 37 (see FIG. 4) within the housing 39 of wall attachment 35.

The invention claimed is:

1. An automatic door actuating system for actuating a hinged door in opening and closing displacement, said system having a reversible electric motor mounted on the hinged door adjacent the free edge of the door, said motor being in driving relation with a pulley, said pulley engaging a tensioned flexible line, said line extending substantially horizontally between a first attachment point on a lintel portion of said door frame and a second attachment point on a surface located adjacent said door free edge when said door is in a fully open position; and means for energising said motor in a selected mode of opening and closing rotation, whereby, upon energization of said motor said pulley engages said line to draw said door in a respective opening/closing displacement; a gear wheel secured to said pulley for rotation therewith, and a toothed rack projecting from said lintel to engage said gear wheel when said door is in a substantially closed position, whereby with said gear wheel engaged by said toothed rack, said motor can displace said door relative to said frame, independently of said flexible line.

2. The door actuating system as set forth in claim 1, including a clutch interposed between said motor and said pulley, to disconnectably connect said motor with said pulley.

3. The door actuating system as set forth in claim 1, including an encoder positioned in motion reading relation with said gear, to provide signal outputs related to said door displacement.

4. The door actuating system as set forth in claim 2, including a reduction gear connecting said motor with said clutch.

5. The door actuating system as set forth in claim 2, wherein said clutch is an electrically actuated clutch, to selectively engage said electric motor with said pulley only upon energization of said clutch.

6. The door actuating system as set forth in claim 3, including a microprocessor connected in signal-receiving relation with said encoder, said microprocessor being connected in energizing relation with said electric motor.

7. The door actuating system as set forth in claim 1, including a resilient latch clip mounted in displacing relation with a latch portion of said door, in use to over-ride the operation of said door latch portion upon displacement of said door by the application of force thereagainst.

8. The door actuating means as set forth in claim 6, said microprocessor having circuitry including a back-up battery; a jack for connection to a household electrical supply, to energise said microprocessor; a plurality of output relays respectively connected with said motor and said clutch; a signal receiver; a variable potentiometer for selectively controlling a selected time-function of said microprocessor; a signal tuner for selecting a predetermined signal code to signal said microprocessor; a plurality of function-modifying dip switches, to enable the programming of said microprocessor; and at least one on/off control switch to de-energise said motor.

9. The door actuating system as set forth in claim 1, said pulley comprising a first pulley and a second pulley, wherein said second pulley is in coaxial, substantially adjoined relation with said first pulley; said tensioned flexible line comprising a first line extending from said door lintel in secured, wrapping relation with said first pulley; a second line extending from said second attachment point and secured in oppositely wrapped relation with a said second pulley; and a spring located at said second attachment point in attached, tensioning relation with said second line, whereby said second and said first lines are maintained in a substantially uniformly tensioned condition for all positions of said door.

10. The door actuating system as set forth in claim 1, having an enclosure extending beneath said electric motor in access limiting relation therewith.

11. The door actuating system as set forth in claim 1, including a sensor selected from the group consisting of optical and magnetic sensors, to monitor incremental rotation of mechanical components of the system.

12. The door actuating system of claim 11, wherein said sensor consists of an optical sensor responsive to rotation of said gear wheel.

13. The door actuating system of claim 11, wherein said sensor consists of a magnetic sensor responsive to rotation of said gear wheel.

14. The door actuating system as set forth in claim 8, wherein said signal receiver and said signal code are selected from the group consisting of IR and RF receivers and codes.

15. The door actuating system as set forth in claim 14, wherein said signal receiver and said signal tuner are for IR signals.

16. The door actuating system as set forth in claim 14, wherein said signal receiver and said signal tuner are for RF signals.

* * * * *